US005175944A

United States Patent [19]

Fruehauf

[11] Patent Number: 5,175,944

[45] Date of Patent: Jan. 5, 1993

[54] DEVICE FOR DISPLAYING AND HEATING AN ARTICLE OF CLOTHING

[76] Inventor: William L. Fruehauf, 4411 Bee Ridge Rd., Suite 584, Sarasota, Fla. 34233

[21] Appl. No.: 684,324

[22] Filed: Apr. 12, 1991

[51] Int. Cl.[5] ..... F26B 19/00

[52] U.S. Cl. ..... 34/88; 34/60

[58] Field of Search ..... 34/202, 195, 196, 219, 34/224, 225, 233, 88

[56] References Cited

U.S. PATENT DOCUMENTS 1,755,013 4/1930 McCormick ..... 34/88 X 2,425,546 8/1947 Lindsey ..... 34/88 X 5,016,364 5/1991 Cochrane ..... 34/202

*Primary Examiner*—Henry A. Bennet

*Attorney, Agent, or Firm*—Charles J. Prescott

[57] ABSTRACT

A device for displaying cyclically heating an article of clothing placed thereover to a temperature at which color-changeable ink imprinted on the clothing either changes color or becomes invisible. The preferred embodiment simulates an upper torso and is formed of transparent plastic panels to snugly receive a shirt thereover.

7 Claims, 2 Drawing Sheets

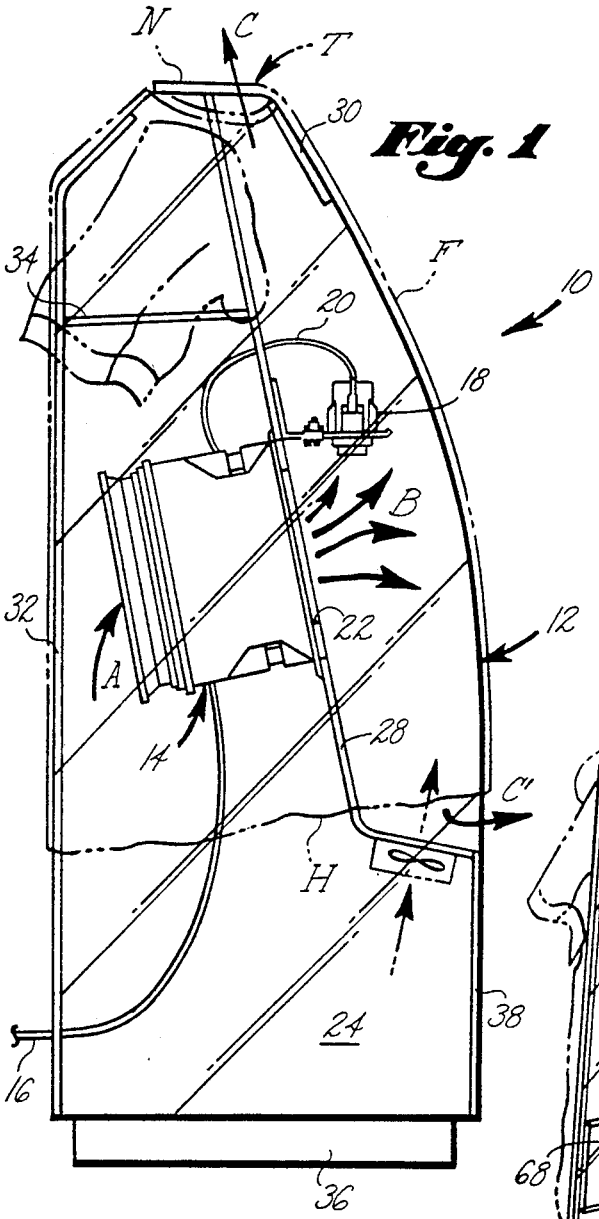
Fig. 1
Fig. 3
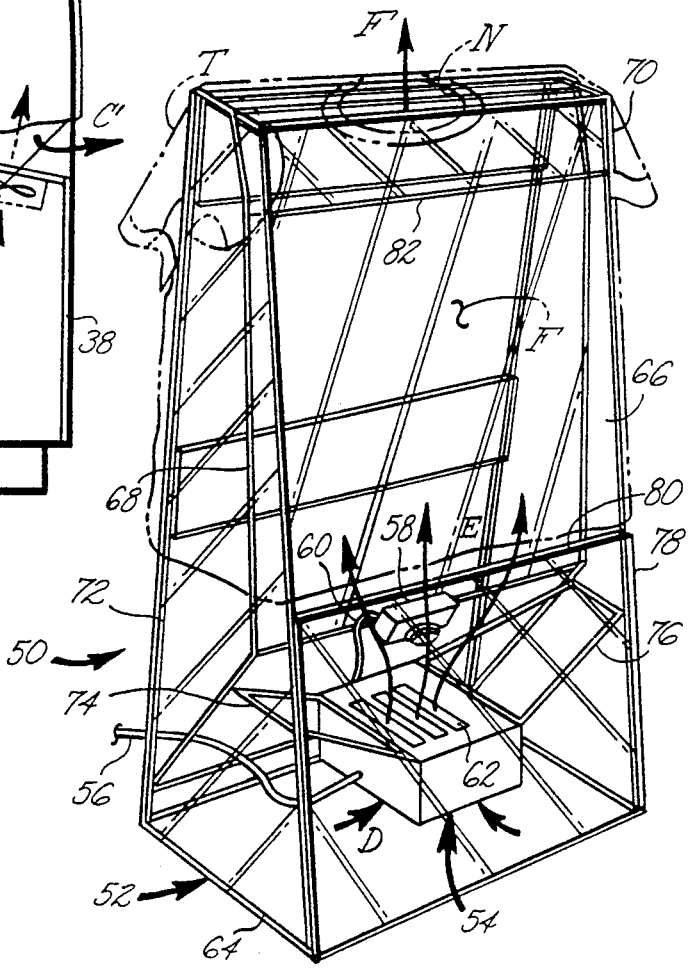

DEVICE FOR DISPLAYING AND HEATING AN ARTICLE OF CLOTHING

BACKGROUND OF THE INVENTION

This invention relates generally to display devices, and more particularly to a device for displaying an article of clothing and for cyclically changing the clothing temperature so as to affect color-changable ink imprinted onto the article of clothing.

Presently, articles of clothing such as novelty t-shirts and the like are being manufactured with designs imprinted thereon formed of color changeable ink. One manufacture of such color changeable ink is The Matsui Shikiso Chemical Company Ltd. which distributes a wide range of such ink products under its trademark CHROMICOLOR textile screen printing ink.

This CHROMICOLOR ink is specially formulated for screen printing on textiles and includes the unique property of either changing color or becoming invisible when brought to its particular color changing temperature range.

Applicant is in the business of manufacturing and distributing such articles of clothing but was unable to locate any display means for dramatizing to potential customers the unique features of such a line of clothing.

The present invention provides a display device for articles of clothing containing color changeable indicia printed thereon and for varying the temperature of that article of clothing so as to depict the color changeable design features for viewing by observers.

BRIEF SUMMARY OF THE INVENTION

This invention is directed to a device for displaying cyclically heating an article of clothing placed thereover to a temperature at which color-changeable ink imprinted on the clothing either changes color or becomes invisible. The preferred embodiment simulates an upper torso and is formed of transparent plastic panels to snugly receive a shirt fitted thereover.

It is therefore an object of this invention to provide a device for displaying and heating an article of clothing which is imprinted with color changeable ink activated to either change color or to become invisible at a predetermined temperature.

It is another object of this invention to provide an upper torso display for t-shirts which will vary the temperature of the t-shirt so as to activate color changeable patterns imprinted onto the t-shirt.

In accordance with these and other objects which will become apparent hereinafter, the instant invention will now be described with reference to the accompanying drawings.

BRIEF DESCRIPTION OF THE DRAWINGS

FIG. 1 is a side elevation view of the preferred embodiment of the invention showing a t-shirt stretched thereover in phantom.

FIG. 3 is a perspective view of another embodiment of the invention showing a t-shirt stretched thereover in phantom.

DETAILED DESCRIPTION OF THE INVENTION

Figure 2:
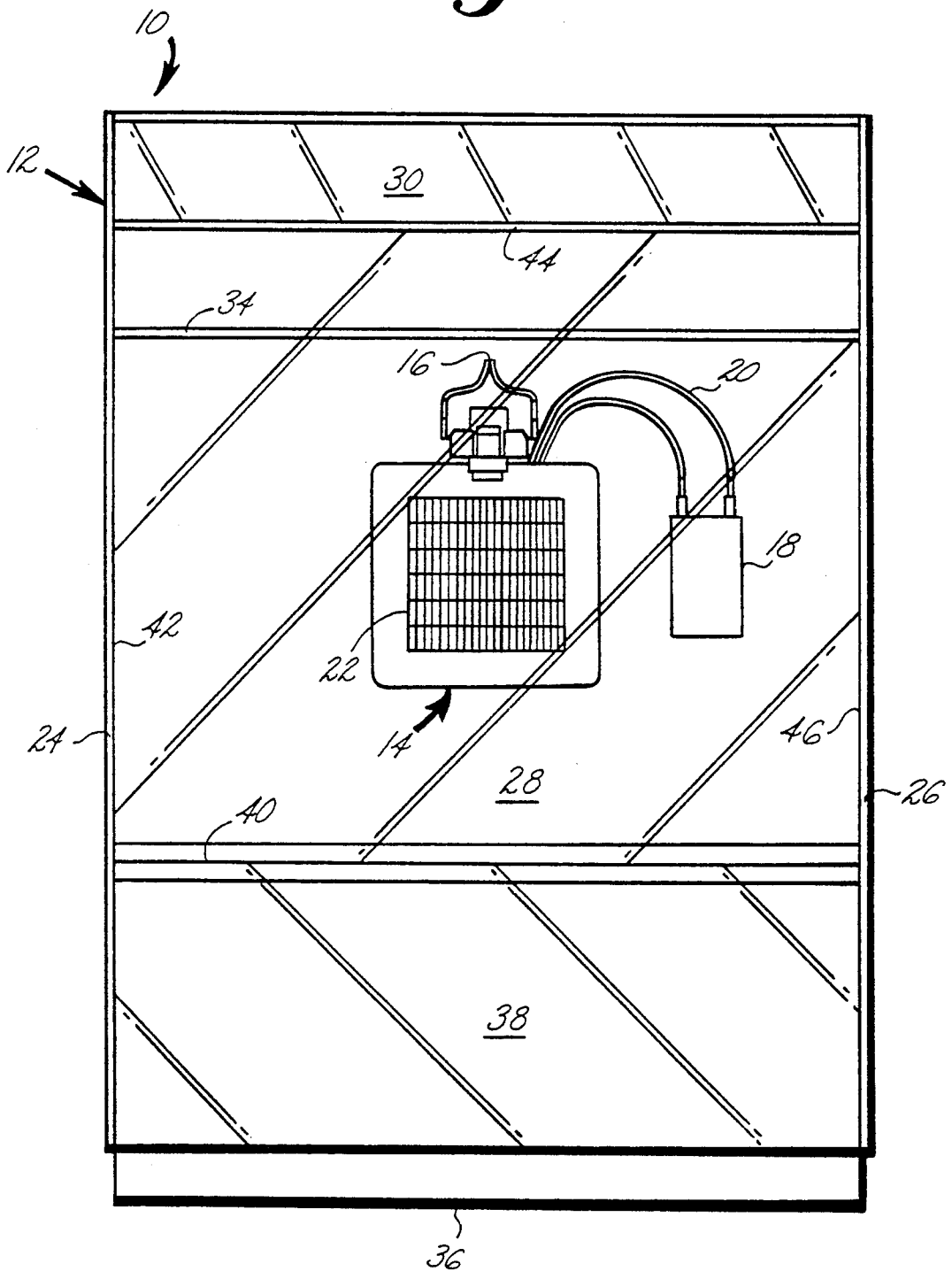
FIG. 2 is a front elevation view of FIG. 1.

Referring now to the drawings, and particularly to FIGS. 1 and 2, the preferred embodiment of the invention is shown generally at numeral 10. This device 10 includes a frame 12 which is fabricated generally of a plurality of transparent plastic or glass panels which are shaped and connected so as to simulate an upper torso.

The transparent panels utilized in frame 12 include upright side panels 24 and 26, an upright back panel 32, a lower and upper front panel 38 and 30, respectively, an intermediate transverse upright panel 28, and a horizontal bracing panel 34.

Connected to intermediate formed transverse panel 28 is a heater-blower 14 having its discharge connected in alignment with opening 22 formed in transverse panel 28. The blower 14 is connected to a power source by electrical conduit 16 and, in operation, draws air into itself in the direction of arrow A for heating and discharge through aperture 22 in the direction of arrows B.

The air discharging from aperture 22 in the direction of arrows B is heated by blower 14, the temperature of which is sensed by temperature controller 18 which by electrical conduit 20 regulates the operation of blower 14.

Side panels 24 and 26 extend forwardly of transverse panel 28 such that the front F of a t-shirt T stretched thereover (in phantom) is displayed for viewing but is otherwise unsupported. Thus, the heated air flowing from aperture 22 into the chamber defined by side panels 24 and 26, intermediate transverse panel 28, and the front F of the t-shirt T has a maximum effect upon quickly altering the temperature of t-shirt front F.

The air blown into the above-defined chamber is allowed to discharge in the direction of arrow C through neck N of the t-shirt T as the upper end of the device 10 is open, and may also discharge in the direction of arrow C′ of the hem H of the t-shirt T.

When the t-shirt T has color changeable ink imprinted on the front F, the blower 14 may therefore be used to regulate the temperature of the front F of the t-shirt T so as to cyclically bring the color changeable ink into and out of its critical temperature changing range. This critical temperature range is typically in the range of 30 to 135 degrees F.

Because the volume of the chamber defined in part by the front F of t-shirt T is relatively small, the blower 14 may easily and rapidly vary the temperature of the air discharging therefrom up and down by the cyclic addition of heat so as to quickly cycle the color changeable ink for dramatic display of these articles of clothing. However, an auxiliary air blower 15 (in phantom in FIG. 1) may also be provided to more quickly evacuate heated air, if desired.

The color changeable ink may be either in the form of true color changeable ink or alternately in the form which becomes invisible in the critical temperature range.

Referring now to FIG. 3, an alternate embodiment of the invention is shown generally at 50. This device 50 is also fabricated of transparent plastic panels which generally simulates an upper torso over which a t-shirt T (shown in phantom) may be stretched for display.

The frame itself shown at 52 and is formed of transparent upright side panels 64 and 66 held spaced apart by lower and upper front panels 78 and 70, respectively, back panel 72, and intermediate formed transverse panel 68.

A blower heater 54 is held in place as shown by diagonal panels 74 and 76 so that, in operation, the blower 54 will draw air thereinto in the direction of arrow D for heating and upward discharge of the heated air in the direction of arrows E.

A forwardly facing opening over which the front F of the t-shirt T is positioned is defined by the upper edge 80 of lower front panel 78, the forwardly edges of side panels 64 and 66, and the lower margin 82 of upper front panel 70. The front F of t-shirt T is positioned over this above-defined opening so as to be maximally effected temperature-wise by the air discharging in the direction of arrow E from blower 54. The forced heated air flow against t-shirt front F then discharges upwardly in the direction of arrow F through neck 40.

This embodiment 50 also includes a temperature sensor and controller 58 which regulates the temperature of the air flowing in the direction of arrow E from blower 54 so as to cycle the temperature color changeable ink imprinted on the front F of t-shirt T quickly into and out of its critical color changing temperature as previously described.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A device for displaying and heating an article of clothing comprising:

a transparent outer housing sized to receive the article of clothing treated with color change ink fitted thereover, said frame generally similar to a portion of a human anatomy over which the article of clothing is intended to be worn;

heating means operably connected within said transparent housing for elevating at least a portion of the article of clothing to a color change temperature range within said color changeable ink imprinted on that portion of the article of clothing changes color or becomes invisible.

2. A device as set forth in claim 1, wherein:

said transparent housing is similar in shape to that of an upper torso.

3. A device as set forth in claim 1, wherein:

said transparent housing defines an interior volume in combination with the article of clothing;

said heating means includes a blower for moving temperature controlled air into said interior volume.

4. A device as set forth in claim 3, further comprising:

temperature regulating means for sensing temperature within said transparent housing and for providing control feedback to said heating means to cycle the temperature of the article of clothing in and out of the color change temperature range.

5. A device as set forth in claim 4, further comprising:

an auxiliary air blower connected to said transparent housing structured to evacuate heated air from said interior volume when said heating means is deactivated.

6. A device for displaying and heating an article of clothing treated with a color change ink comprising:

a plurality of thin transparent panels connected to form a three dimensional outer housing similar to that of a portion of the human anatomy;

said plurality of connected panels also defining an interior volume in combination with the article of clothing snugly fitted over said three dimensional shape into which a blower controllably discharges heated air;

control means in said interior volume for regulating operation of said blower so as to cyclically elevate the temperature of the article of clothing to a color change temperature range within which color changeable ink imprinted on the article of clothing changes color or becomes invisible.

7. A device as set forth in claim 6, further comprising:

an auxiliary air blower connected to said frame structured to evacuate heated air from said interior volume when said heating means is deactivated.

* * * * *